US010563391B2

(12) United States Patent
Dirkskötter

(10) Patent No.: US 10,563,391 B2
(45) Date of Patent: Feb. 18, 2020

(54) DEVICE FOR FORMING CAVITIES IN THE GROUND FOR WATER DRAINAGE AND/OR WATER STORAGE

(71) Applicant: Hewitech GmbH & Co. KG, Ochtrup (DE)

(72) Inventor: Frank Dirkskötter, Ochtrup (DE)

(73) Assignee: Hewitech GmbH & Co. KG, Ochtrup (DE)

( * ) Notice: Subject to any disclaimer, the term of this patent is extended or adjusted under 35 U.S.C. 154(b) by 0 days.

(21) Appl. No.: 16/093,179

(22) PCT Filed: Apr. 3, 2017

(86) PCT No.: PCT/EP2017/057866
§ 371 (c)(1),
(2) Date: Oct. 12, 2018

(87) PCT Pub. No.: WO2017/178267
PCT Pub. Date: Oct. 19, 2017

(65) Prior Publication Data

US 2019/0119895 A1 Apr. 25, 2019

(30) Foreign Application Priority Data

Apr. 12, 2016 (DE) ..... 10 2016 106 673

(51) Int. Cl.
*E03F 1/00* (2006.01)
*E02B 11/00* (2006.01)

(52) U.S. Cl.
CPC ..... *E03F 1/005* (2013.01); *E02B 11/005* (2013.01)

(58) Field of Classification Search
CPC ..... E03F 1/005; E02B 11/005
(Continued)

(56) References Cited

U.S. PATENT DOCUMENTS 924,153 A * 6/1909 Elliot ..... 405/133
2,246,623 A * 6/1941 Dorey ..... E04H 13/001 405/272

(Continued)

FOREIGN PATENT DOCUMENTS

DE 299 24 050 U1 10/2001
DE 20 2004 018 319 U1 6/2005

(Continued)

OTHER PUBLICATIONS

International Search Report and Written Opinion for corresponding Patent Application No. PCT/EP2017/057866 dated Jun. 29, 2017.

*Primary Examiner* — Carib A Oquendo
(74) *Attorney, Agent, or Firm* — Renner, Otto, Boisselle & Sklar, LLP

(57) ABSTRACT

The invention relates to a device for forming cavities in the ground for water drainage and/or water storage. Said device comprises a cube- or cuboid-shaped installation body (10), which has a front side (42) and an opposite back side (44), a top side (20) and an opposite bottom side (18), and two opposite lateral sides (22). The front side (42), the back side (44), the top side (20), the bottom side (18), and the lateral sides (22) have strand elements (14) arranged parallel or substantially parallel to each other. In the corner regions of the installation body (10) between the top or bottom side (20, 18) and one of the lateral sides (22), corner connecting elements (12) for the insertion connection of the strand elements (14) of the top side (20) or of the bottom side (18) to the strand elements of the lateral side (22) are arranged.

16 Claims, 6 Drawing Sheets

Figure 1:
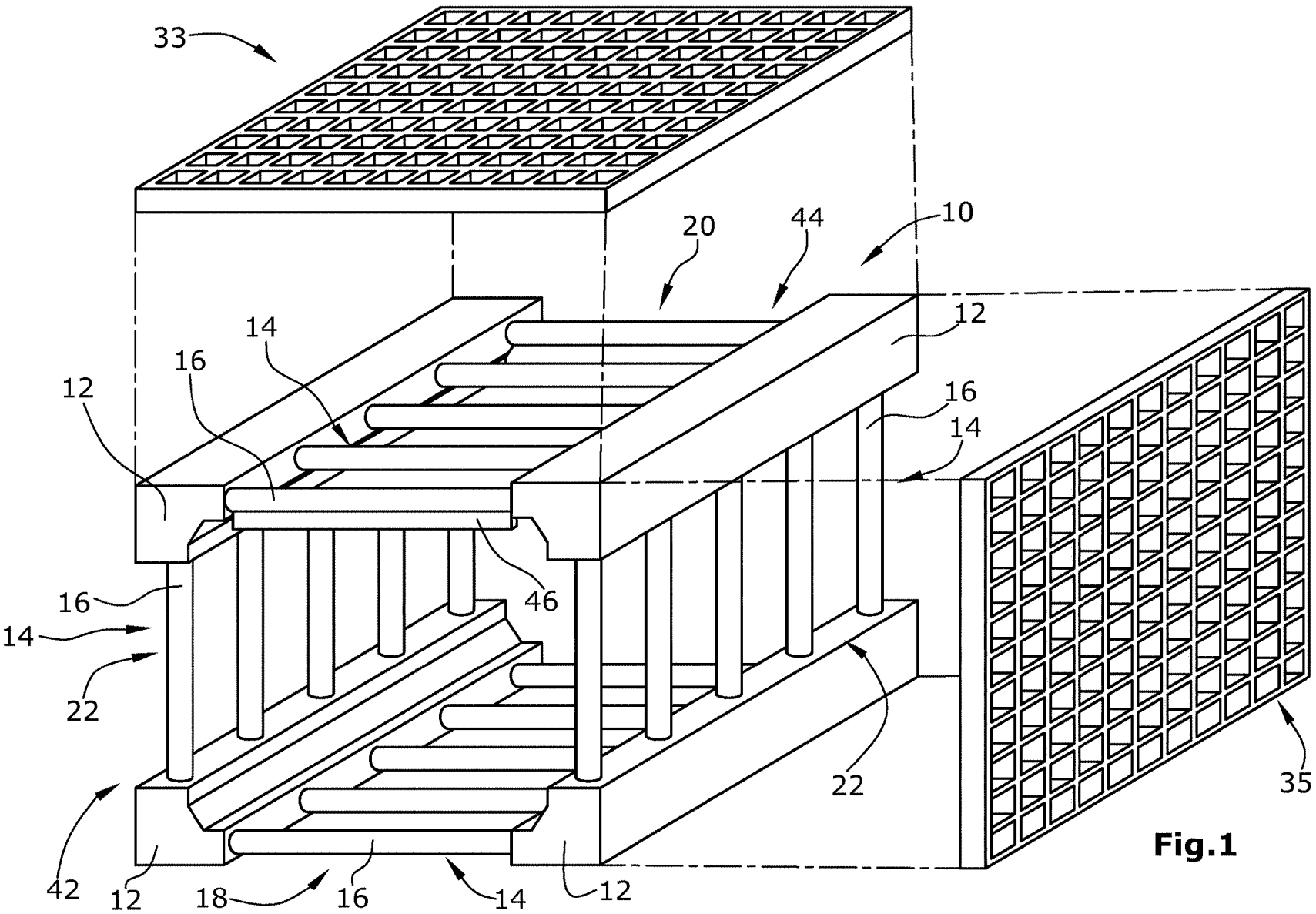

(58) Field of Classification Search
USPC ..... 405/36, 43, 45, 52, 53, 114, 126, 129.1, 405/129.85, 272, 273, 276, 277, 278, 279, 405/281, 282
See application file for complete search history.

(56) References Cited

U.S. PATENT DOCUMENTS

| | | | | |
|---|---|---|---|---|
| 5,199,824 | A * | 4/1993 | Smith | E02D 17/08 405/272 |
| 6,416,259 | B1 * | 7/2002 | Meyer | E02D 17/04 405/272 |
| 2005/0141970 | A1 * | 6/2005 | Glamuzina | E02D 17/083 405/272 |
| 2010/0296871 | A1 * | 11/2010 | Heitker | E03F 1/005 405/43 |

FOREIGN PATENT DOCUMENTS

| | | | |
|---|---|---|---|
| DE | 20 2006 008 981 | U1 | 10/2006 |
| DE | 10 2005 050 880 | B3 | 4/2007 |
| DE | 20 2007 016846 | U1 | 3/2008 |
| DE | 10 2007 058 785 | B3 | 8/2009 |
| DE | 10 2009 052 724 | A1 | 5/2011 |
| EP | 1 437 305 | A2 | 7/2004 |
| EP | 1 607 535 | A1 | 12/2005 |
| EP | 2 682 534 | A1 | 1/2014 |
| WO | WO 2007/118894 | A1 | 10/2007 |

* cited by examiner

DEVICE FOR FORMING CAVITIES IN THE GROUND FOR WATER DRAINAGE AND/OR WATER STORAGE

The invention refers to a device for forming cavities in the ground for water drainage and/or water storage. The invention relates in particular to a pluggable dewatering and/or drainage device for installation in the ground.

For the storage of temporarily occurring large quantities of surface water it is known to form cavities in the ground that receive the surface water in the manner of a dry well, to then discharge it into the sewer system in a "dosed" manner. Due to this measure, the sewer system does not have to be designed for receiving extremely large quantities of water.

For forming cavities in the ground for water drainage and/or water storage purposes, it is known to use cubic or cuboid installation bodies of plastic material which are arranged side by side and stacked one upon the other, creating a free space in the ground. Generally, such installation bodies are lattice boxes which, besides their function of creating free spaces or cavities, must also have a certain stability so that the area above the cavity remains trafficable as is the case e.g. with parking lots or similar surfaces on which vehicles can drive.

For various reasons it is advantageous if the lattice boxes can be delivered as individual parts in a space-saving manner, to then be assembled in situ and be installed in the ground afterwards. Here, it is desired to use as little plastic material per lattice box as possible without compromising the bearing capacity of the e.g. trafficable surface above a cavity.

Pluggable dewatering and/or water drainage devices for installation in the ground are known for example from DE 299 24 050 U1, DE 20 2004 018 319 U1 and DE 10 2007 058 785 B3. Other drainage and dewatering bodies formed from individual parts for use as dewatering and/or drainage devices for installation in the ground are known from EP 1 437 305 A2 and EP 1 607 535 A1. Finally, it is known from DE 10 2005 050 880 B3 to provide a drainage element for installation in the ground, which is composed of a plurality of plate-shaped lattice mats through which a passage extends. Further, a percolation and drainage body built from individual plate elements is also known from DE 20 2006 008 981 U1.

It is an object of the invention to provide a device for forming cavities in the ground for water drainage and/or water storage, which device is adapted to be assembled from only a few parts by plugging, where as many parts as possible are formed as identical parts.

The object is achieved by the invention by providing a device for forming cavities in the ground for water drainage and/or water storage, the device comprising

- a cube- or cuboid-shaped installation body which has a front side and an opposite back side, a top side and an opposite bottom side, and two opposite lateral sides,
- wherein at least four or five sides of the front side, the back side, the top side, the bottom side, and the lateral sides have strand elements extending parallel or substantially parallel to each other, and
- wherein, in the corner regions of the installation body between a respective top or bottom side and one of the lateral sides, corner connecting elements are arranged for the plug-in connection of the strand elements of the top side or of the bottom side and those of the lateral side with a corner connecting element.

It is an essential feature of the invention that at least four or five sides of the six sides of the cube- or cuboid shaped installation body are respectively provided with preferably identical strand elements of plastic material which are arranged parallel or substantially parallel relative to each other. In particular, it is provided that two pairs of opposite sides of the installation body are respectively provided with the above-mentioned strand elements having the respective designs described before. On the other hand, this does not exclude that also all six sides of the installation body are provided with the above described strand elements in the manner described before.

Preferably, the strand elements are plastic tubes. In the corner regions of the installation body, i.e. in the corner transition region from the top or bottom side to one of the lateral sides, the strand elements are connected to each other by corner connecting elements, i.e. by a plug-in connection of the strand elements and the corner connecting elements. A "strand element" in the sensor of the invention means an elongated or longitudinal, preferably profile element made of metal, plastic material or a fiber-reinforced plastic material. Such an element can be formed in different ways, e.g. by folding a metal strip, by extrusion molding or by extrusion. What matters is that the strand element is rigid against bending which, if necessary, may be achieved or improved by reinforcement ribs or similar reinforcing structures. The materials of which the installation body of the present invention is made, should be high-strength materials, i.e. have a corresponding modulus of elasticity, as is the case with metals and high-strength plastic materials.

Surprisingly, it has been found that the lateral sides of a cube- or cuboid-shaped installation body, which bear the major part of the load, can be realized by providing plastic material strand elements at that position, in particular tubes, arranged vertically or upright. The top and the bottom side of the installation body are also provided with such strand elements. The number of strand elements per unit length determines, among other things, the bearing strength/stability of the installation body. The number and/or the mutual distance of the strand elements per side or per pair of sides of the installation body may be equal or different and may be equal or different per pair of respective opposite sides of the installation body.

The installation body of the present invention has the advantage that the strand elements on the lateral sides on the one hand and the strand elements on the top and/or bottom side on the other hand may differ in stability with a view to different load requirements (pressure stabilization at the lateral sides vs. bending rigidity at the top and/or the bottom side), depending on the installation position in the ground (stable against bending at the top side in the upper layers near the ground surface, and stable against vertical loads in the lower layers at the lateral sides).

The device of the present invention can be transported in a space-saving manner in as far as its individual elements, i.e. the strand elements and the corner connecting elements, are all strand-shaped and can thus be transported in a mutually parallel arrangement. In situ, the strand elements are connected with the corner connecting elements by plugging, and the installation body is assembled in this manner. In this regard, it is advantageous with a view to the assembly of the installation body and the handling of the same when arranging a plurality of installation bodies side by side or one above the other in order to form a cavity in the ground, if the plug-in connections are secured against inadvertent detachment. This may be realized e.g. by frictional engagement of the strand elements at the corner connecting elements or by locking, i.e. force and/or form fitting.

By changing the number of strand elements at the top side and/or the lateral sides of the installation side according to the invention, it is possible to use installation bodies of different stability and resistance per layer of installation bodies arranged on upon the other. For example, it is suitable to provide the topmost layer of installation bodies with more strand elements at the top side and/or at the lateral sides than is the case for the installation bodies of the next or all other lower installation layers. In this case, the topmost installation layer of installation bodies allows the thickness of the ground layer above the cavity defined by the installation bodies to be thinner than usual. Correspondingly, it is also possible to provide the installation bodies vertically with more strand elements in the lower installation layers, i.e. at the lateral sides, than at the top or the bottom side (up to three times). The installation bodies of the lower layers mainly have to absorb vertical loads. This can be realized by increasing the number of strand elements at the lateral sides with respect to the those at the top and/or bottom sides, and/or by using strand elements at the lateral sides that are more stable than the strand elements of the top and/or bottom sides.

The concept of a pluggable installation body, underlying the invention, also allows for a more variable design of the dimensions of the installation body. Thus, the length of the corner connecting elements and/or of the strand elements and the number of the strand elements that can be connected by the corner connecting elements may be variable.

In a further advantageous embodiment of the invention it may be provided that the top side of the installation body comprises a greater number of strand elements that the bottom side and/or the lateral sides. Further, it is possible, according to the invention, that the length of the strand elements of all sides of the installation body is the same.

In a further advantageous embodiment of the invention it may be provided that the strand elements of the top side and of the bottom side have the same first length, and the strand elements of the two lateral sides have the same second length, and that the first length is different from the second length.

As already discussed above, a plastic material extruded tube is particularly suited as a strand element. Other possible designs of the strand elements as extruded profile elements are angle elements, elements with cylindrical peripheral surface in a mathematical sense, or the like.

The plug-in connection of the strand elements and the corner connecting elements may preferably be realized such that the corner connecting elements have receiving openings for receiving the ends of the strand elements in a plugged manner and/or have projections onto which the ends of the strand elements can be plugged.

Depending on the occurring loads to be expected, it may be required to further stabilize/strengthen the installation body of the invention selectively and individually. To this end, stabilizing elements may be positioned between the strand elements of opposite sides of the installation body. The at least one stabilizing element serves as a spacer between one or more strand elements of the bottom side. For example, a possible stabilizing element is a strand element whose ends are provided with receptacles e.g. for plugging onto opposite strand elements between which the stabilizing element is to be arranged. An Installation body according to the invention may have e.g. one or a plurality of such stabilizing elements, provided that, at their opposite ends, the stabilizing elements can be plugged or clipped securely on the respective strand elements against inadvertent detachment.

The corner connecting elements provided according to the invention are preferably also made of plastic material, although they generally are injection molded plastic parts. They may be constructed to be symmetrical, but also asymmetrical with respect to a plane which is substantially diagonal with respect to the assembled installation body. The corner connecting elements may be perforated and may, in this respect, have at least partial lattice structures, whereby the flushability of the installation body and thus of the installation body arrangement in the ground is enhanced.

In a further advantageous embodiment of the invention it may be provided to enclose the installation bodies with a nonwoven, in particular a geotextile, so as to prevent ground from getting into the interior of the installation body. Such a covering of the sides of the installation body is particularly advantageous for the installation bodies of the installation body arrangement that are next to the ground.

As already mentioned before, it is desirable that the strength and flexural rigidity of the strand elements at the top side of those installation bodies is rather high that are arranged near the ground surface and therefore have to absorb loads in particular when the ground surface is driven on. To this end, all or at least some of the strand elements of the top side may be provided with reinforcing struts arranged on the outside of the strand element or inside the strand element (if the strand element is configured as a hollow profile). Here, one may think of T-profiles, U-profiles, hollow profiles with inner struts. Further, it may be advantageous if a lattice element, e.g. a grid. Is arranged on the top side for additional stiffening. Such a grid may also be arranged in the form of a lattice element on at least one of the lateral sides, the front side and/or the rear side of the installation body, where the respective lattice element protects the installation body against the intrusion of ground. In addition, a nonwoven may be placed in front of such lattice elements.

The entire installation body should be made of a high-strength material. Metal or a plastic material with a sufficiently high modulus of elasticity are suited for that purpose. It is also possible that strand elements and corner connecting elements of both or a plurality of different materials are assembled into one installation body.

As already mentioned before, the connection of the strand elements with the corner connecting elements is made by plug-in connections. The receiving openings and projections addressed above should suitably have perforations so that water present inside the strand elements can be drained. This has the advantage that when the strand elements are formed as hollow profiles, the same may be filled with water so that a maximum possible proportion of the volume of the ground cavity kept clear by the arrangement of installation bodies of the invention is available for the drainage or storage of water and, as a consequence, only a rather small proportion of the volume is occupied by the material of the installation body.

The installation body of the invention may in addition be combined with drainage and dewatering installation bodies of other types in order to form cavities in the ground. For example, it is also possible to use "finer-meshed" lattice bodies in the lateral region of an installation body arrangement adjacent to the ground, i.e. a side-by-side and stacked arrangement of installation bodies, which lattice bodies are, in addition, covered with a nonwoven or the like water-permeable material on their sides facing to the ground. Examples of installation bodies which can be combined with the installation body of the invention for this purpose are described in DE 10 2007 058 785 B3, DE 10 2009 052 724 A1, and WO 2007/118894 A1.

Figure 2:
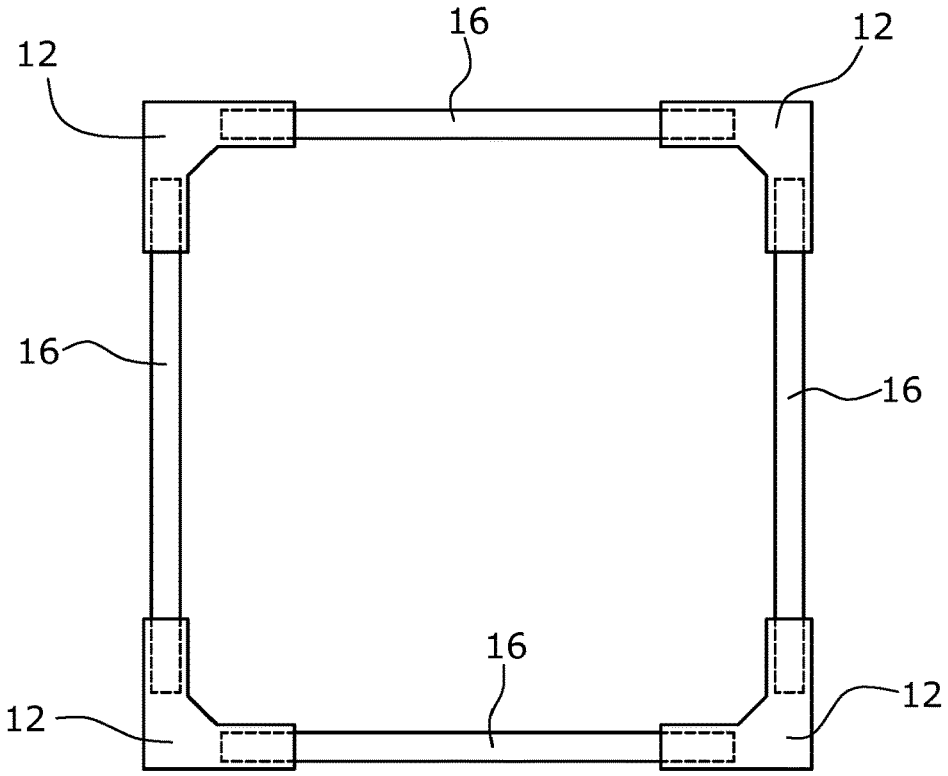
Figure 3:
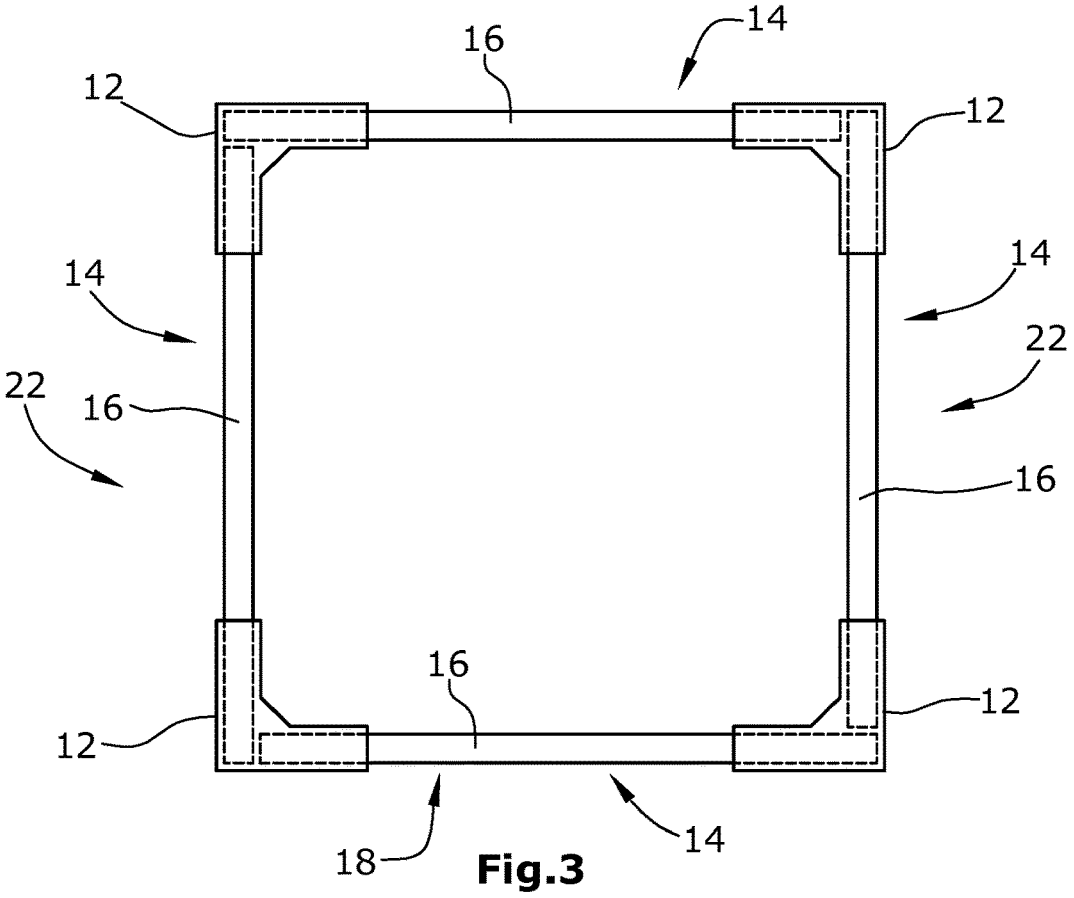
Figure 4:
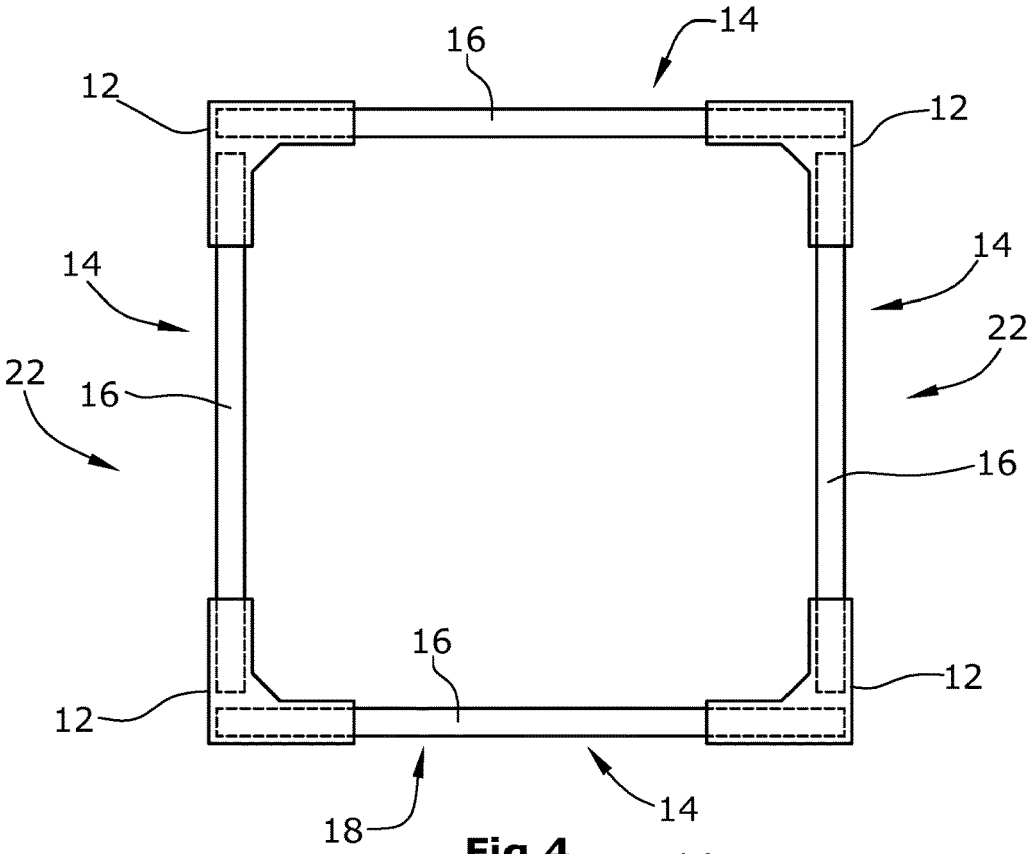
Figure 5:
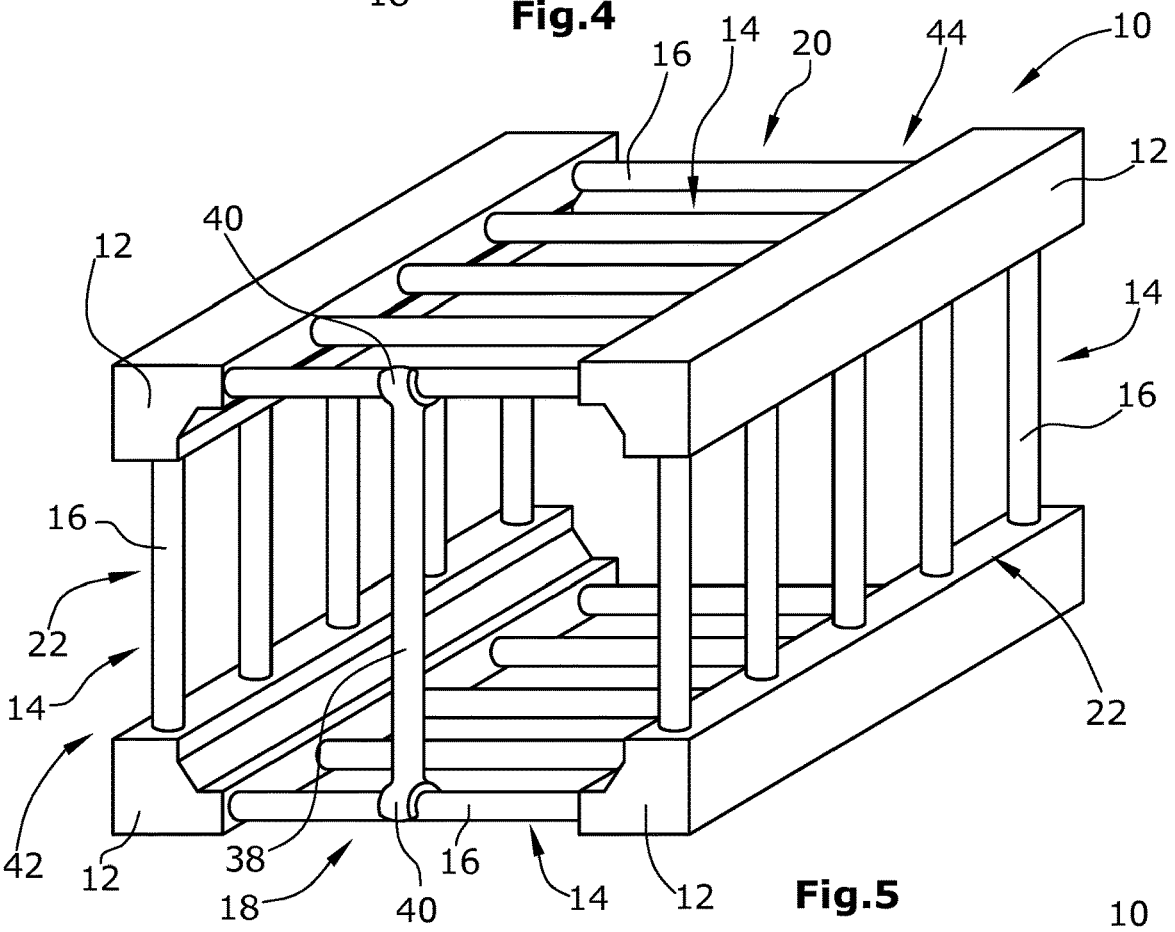
Figure 6:
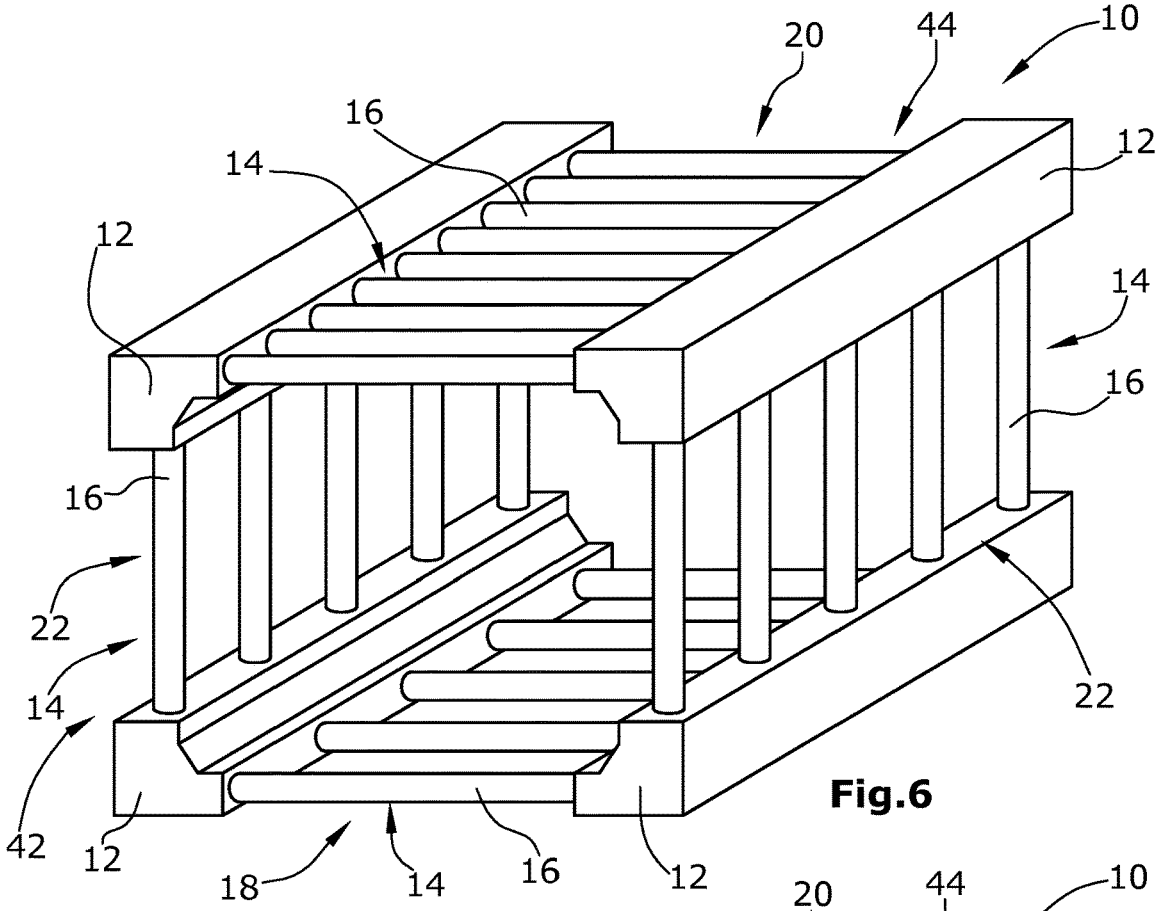
Figure 7:
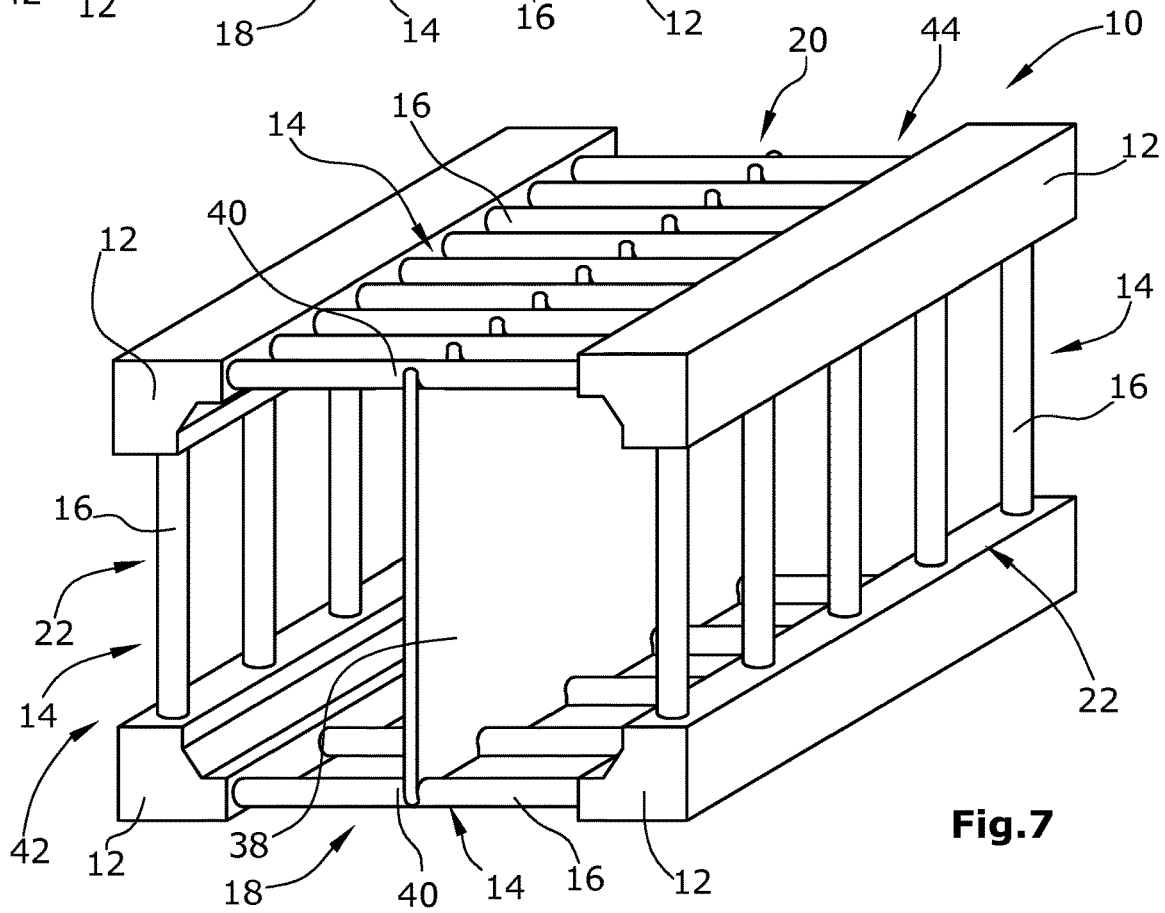
Figure 8:
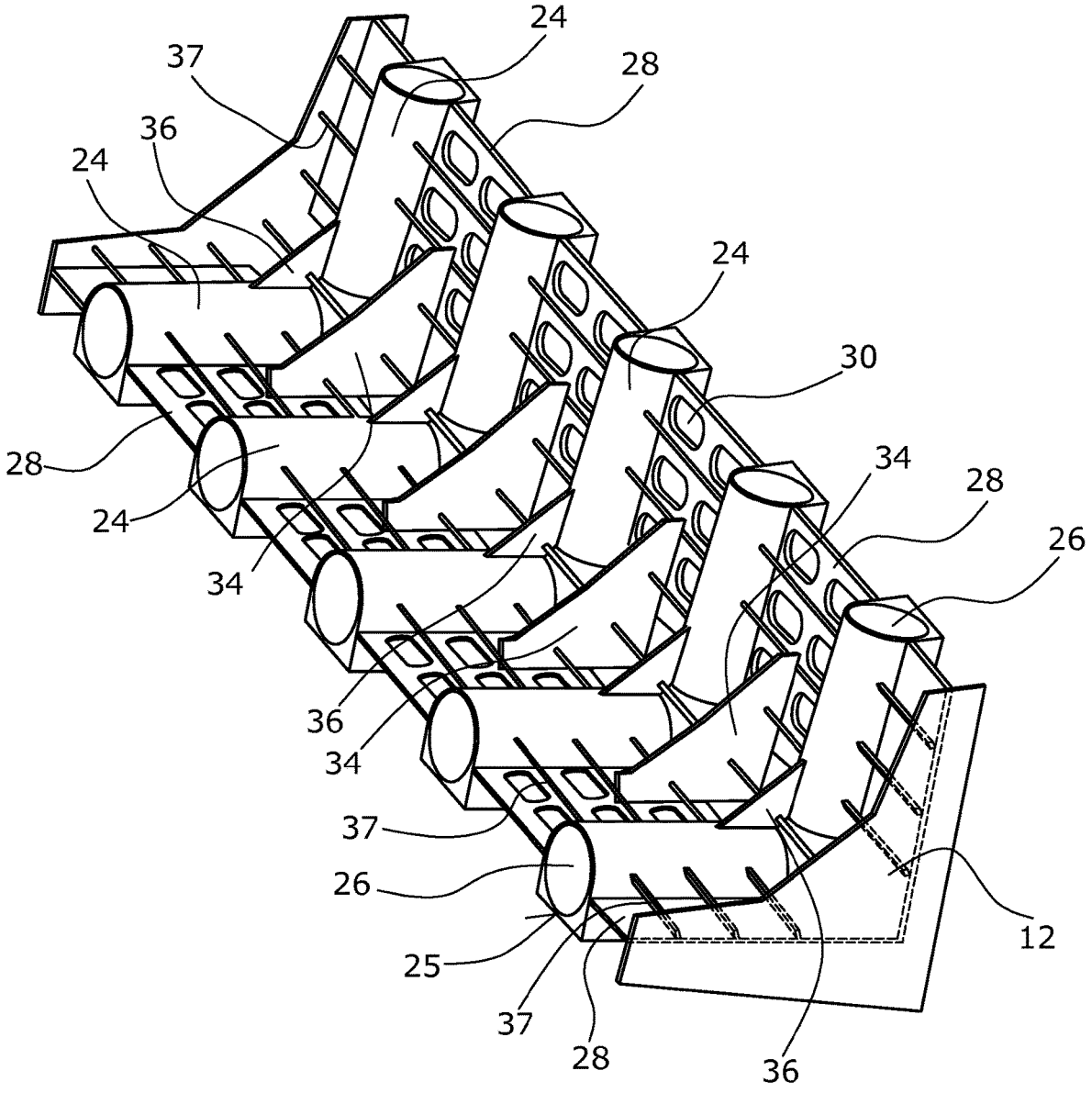
Figure 9:
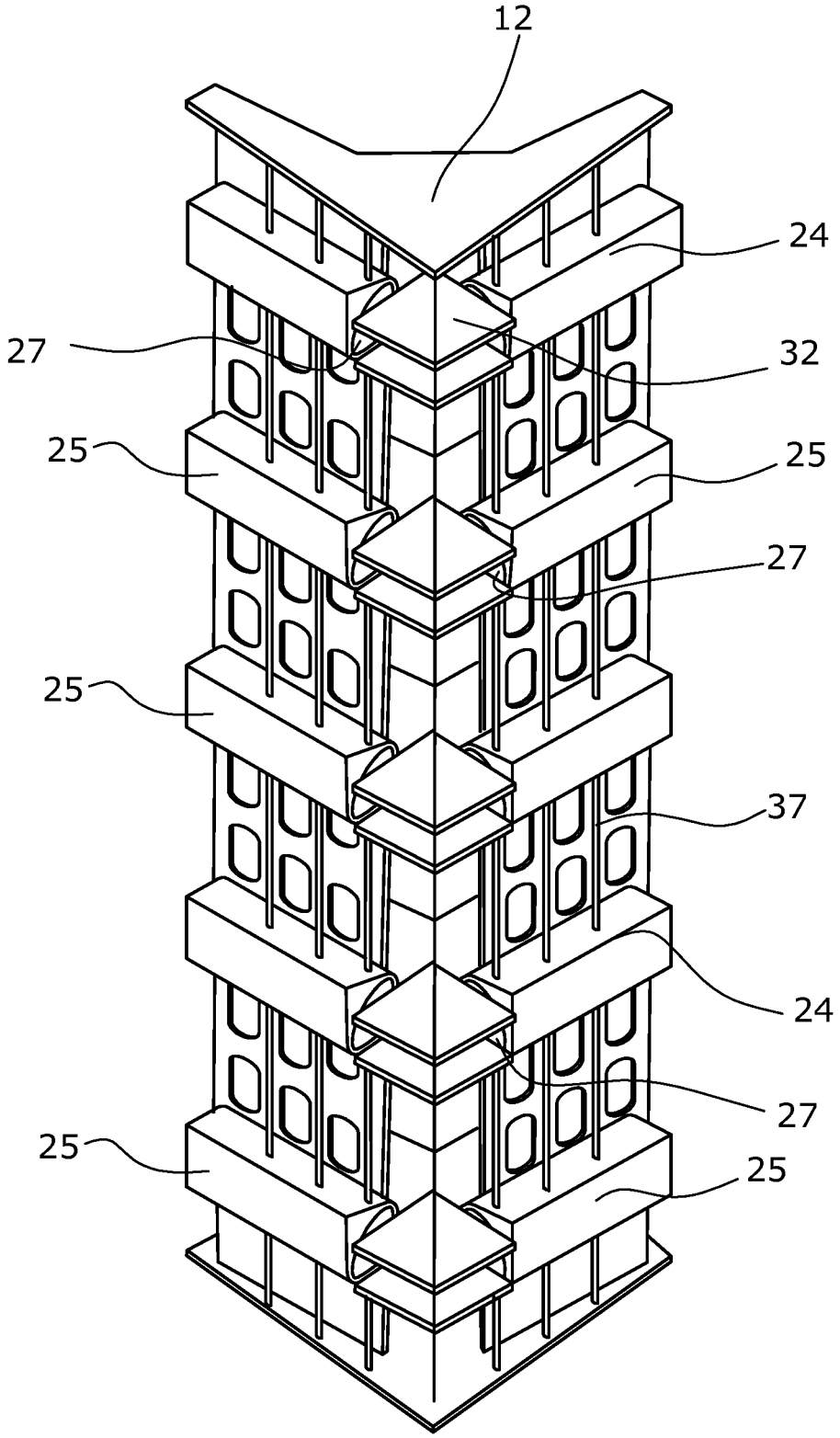

The invention will be described in more detail hereunder with reference to several embodiments and to the drawings. The Figures specifically show:

FIG. 1 a perspective view of a first embodiment of an installation body,

FIGS. 2 to 4 illustrations for clearly showing various plug-in variants for the connection of the strand elements with the corner connecting elements, FIG. 5 an illustration of an installation body similar to FIG. 1, but with one or a plurality of additional stabilizing elements, FIG. 6 an embodiment of an installation body with a number of strand elements at the top side that is greater than the number of strand elements at the lateral sides and the bottom side of the installation body, FIG. 7 an installation body similar to the one in FIG. 6, but with one or a plurality of stabilizing elements, and FIGS. 8 and 9 various views of an embodiment for a lattice connecting element that can be used e.g. with the installation bodies shown in the above Figures.

The Figures illustrate a plurality of embodiments of installation bodies, wherein identical reference numerals respectively identify functionally or structurally identical parts of the individual embodiments.

FIG. 1 illustrates an installation body 10 of plastic material with four schematically illustrated corner connecting elements 12 and a plurality of strand elements 14 in the form of tubes 16, wherein five strand elements 14 are provided on each of the bottom side 18, the top side 20 and the two lateral sides 22. The corner connecting elements 12 are designed e.g. as illustrated in FIGS. 8 and 9. The corner connecting elements 12 of plastic material are provided with receiving openings 26 formed by sleeves 24, which serve to receive the ends of the tubular strand elements 14 by plugging. The sleeves 24 are flattened on the outside (see at 25) and have perforations 27 at their ends (they are open, for example). Thereby, the interior of the strand elements 14 can be used to take up water. The flattened outer sides of the sleeves 24 serve for a better stackability of installation bodies 10 arranged on upon the other.

The corner connecting elements 12 form an angle of 90° and are of symmetrical structure with respect to the angle bisector. The wall portions 28 between adjacent sleeves 24 are provided with holes 30 for better flushability. In the actual corner region, the two sleeves 24 of a receiving opening pair extending towards each other are supported against each other for a plugged receiving of two strand elements, 14, which is realized in the present embodiment by elements 32 in the form of small plates. For the reinforcement of the corner connecting elements 12, the same have first reinforcing walls 34 connecting the wall portions 28 with each other. The first reinforcing walls 34 are arranged alternating with the sleeve pairs. The sleeves 24 of a pair are further reinforced by second reinforcing walls 36. Oblique reinforcing webs are shown at 37, which extend upward from the wall portions 28. In FIGS. 8 and 9 the line of view on the corner connecting element 12 is chosen such that only the edges of the reinforcing webs 37 are visible.

In FIG. 1 lattice plates of e.g. plastic material are schematically shown at 33 and 35 which are arranged either for reinforcement of the top side 20 or for preventing the intrusion of ground at a lateral side 22 and/or the front and/or rear side 42, 44 and are each fixed there.

Finally, FIG. 1 shows at 46 how e.g. the strand elements can be designed with greater flexural stiffness by the use of reinforcing structures. Such reinforcing structures may be present on all strand elements 14 of the top side 20 or also only on some of them. Thereby, the rigidity of the top side 20 of the installation body 10 is further increased.

Referring to FIGS. 2 to 4, it will be shown how the arrangement of the plug-in connections can be realized in the corner connecting elements 12. FIG. 2 illustrates a structure of the corner connecting elements 12 which is symmetric in that respect, whereas FIGS. 3 and 4 show an asymmetric design. In the embodiments shown in FIGS. 2 and 3, strand elements 14 of the same length are used on all sides of the installation body 10. In the embodiment illustrated in FIG. 4, the strand elements 14 at the lateral sides 22 are shorter than the strand elements 14 at the top and bottom sides 20, 18.

FIG. 5 illustrates the installation body of FIG. 1, but with an additional stabilizing element 38 between a tubular strand element 14 at the top side 20 and the opposite tubular strand element 14 at the bottom side 18 of the installation body 10. A plurality of such stabilizing elements 38 may be provided. It is also possible that a stabilizing element 38 e.g. supports two adjacent strand elements 14 of the top side 20 by two adjacent strand elements 14 of the bottom side 18, when the top side 20 of the installation body 10 is loaded. The or each stabilizing element 38 has C-shaped clip-on ends 40 in the manner of a clip, by which the stabilizing element 38 is clipped onto the strand elements 14 to be connected. A stabilizing element 38 is mounted by inserting the stabilizing element 38 in an oblique orientation between the strand elements 14 to be connected and by subsequently erecting the stabilizing element 38 to take the position illustrated in FIG. 5. If so required, a plurality of stabilizing elements 38 can be arranged between two opposite strand elements 14.

FIG. 6 illustrates an embodiment of an installation body 10, in which more tubular strand elements 14 are arranged at the top side 20 than at the lateral sides 22 and at the bottom side 18. Such an installation body 10, as well as e.g. the installation body 10 of FIG. 5, is suited for arrangement near the ground surface below which a cavity is formed for water drainage and/or water storage purposes.

FIG. 7 illustrates an embodiment of an installation body 10 of FIG. 6 with at least one stabilizing element 38 in the form of a plate element which supports a plurality and in particular all strand elements 14 of the top side 20 on the strand elements 14 of the bottom side 18.

As can be seen from the Figures, the installation body 10 according to these embodiments of the invention is free of strand elements 14 at its front and rear sides 42, 44 (possibly except for a stabilizing element 38). The strand elements 14 are thus primarily provided at the other sides of the installation body 10, but may also be provided at the front and rear sides 42, 4. In this far, the invention should be seen in that of the six sides of the cuboid- or cube-shaped installation body 10, at least four sides, of which at least two sides absorb vertical loads in the installed state of the installation body 10 (i.e. at least wo sides of the group of sides comprising the front side 42, the rear side 44 and the two lateral sides 22), are provided with strand elements 14, wherein the sides provided with strand elements 14 are each opposing pairs of sides of the installation body 10.

LIST OF REFERENCE NUMERALS

10 installation body
12 corner connecting element
14 strand element
16 tubes
18 bottom side of the installation body
20 top side of the installation body

22 lateral sides of the installation body
24 sleeves
25 flattenings on the sleeves
26 receiving openings
27 perforations of the sleeves
28 wall portions
30 holes
32 plate-shaped elements
33 lattice plate
34 first reinforcing walls
35 lattice plate
36 second reinforcing wall
37 reinforcing web
38 stabilizing element
40 clip-on ends of the stabilizing element
42 front side of the installation body
44 rear side of the installation body
46 reinforcing element for a strand element

The invention claimed is:

1. A device for maintaining underground cavities for water drainage and/or water storage, the device comprising a cube- or cuboid-shaped installation body which has a front side and an opposite back side, a top side and an opposite bottom side, and two opposite lateral sides, wherein the top side, the bottom side and the lateral sides of the installation body or the front side, the rear side and the lateral sides of the installation body or the front side, the rear side, the top side and the bottom side of the installation body each comprise strand elements extending parallel to each other, and wherein, in corner regions of the installation body between a respective top or bottom side and one of the lateral sides, corner connecting elements are arranged for plug-in connection to more than one of the strand elements of the respective top or bottom side and to more than one of the strand elements of the lateral side.

2. The device of claim 1, wherein the number and/or the mutual distance of the strand elements per side or per pair of sides of the installation body is equal or different.

3. The device of claim 1, wherein the top side of the installations body comprises a greater number of strand elements than the bottom side and/or the lateral sides.

4. The device of claim 1, wherein at least one of the strand elements of the top side of the installation body is reinforced to increase stability, in particular by the selection of the thickness and/or the wall thickness and/or by reinforcing struts on the outside of the strand element and/or inside the strand element and/or that the number and/or the shape of the strand elements at the lateral sides is increased and/or reinforced to increase the vertical stability of the installation body.

5. The device of claim 1, wherein the length and/or the number and/or the shape of the strand elements of all sides of the installation body is equal or different.

6. The device of claim 1, wherein the strand elements of the top and the bottom side have an identical first length, and the strand elements of the two lateral sides have an identical second length, and that the first length differs from the second length.

7. The device of claim 1, wherein the strand elements are formed as extruded profile elements.

8. The device of claim 1, wherein the corner connecting elements comprise receiving openings for plug-in reception of the ends of the strand elements and/or projections onto which the ends of the strand elements can be plugged.

9. The device of claim 8, wherein the strand elements are hollow profile elements, and that the receiving openings of the corner connecting elements have perforated bottoms and/or the projections of the corner connecting elements have perforations outside the strand elements, wherein the perforated bottoms and/or the perforations are provided for draining water present inside the hollow profile elements.

10. The device of claim 1, wherein the strand elements plugged onto and/or into the corner connecting elements are secured at the corner connecting elements against inadvertent detachment.

11. The device of claim 1, wherein at least one stabilizing element is provided for positioning between the strand elements of opposite sides of the installation body.

12. The device of claim 11, wherein the stabilizing elements are configured to be plugged or clipped on the respective strand elements at their opposite ends in a manner secured against inadvertent detachment.

13. The device of claim 11, wherein the stabilizing element is designed as a vertical plate element.

14. The device of claim 1, wherein a lattice plate rests on the strand elements of the top side as a reinforcement of the top side of the installation body and/or that a lattice plate rests on at least one of its lateral sides and/or on its front side and/or on its rear side for protection against the intrusion of soil into the installation body, wherein in both cases the lattice plate is fixed to the respective side or at least to one strand element of the respective side.

15. The device of claim 1, wherein the strand elements and/or the corner connecting elements are made of plastic material, fiber-reinforced plastic material and/or metal.

16. The device of claim 15, wherein some of the strand elements and/or some of the corner connecting elements are made of plastic material, in particular fiber-reinforced plastic material, and the other strand elements and/or the other corner connecting elements are made of metal.

* * * * *